United States Patent [19]

Maloney

[11] Patent Number: 5,075,925

[45] Date of Patent: Dec. 31, 1991

[54] RETRACTABLE HANDLE ASSEMBLY FOR A TRANSPORTABLE CASE

[75] Inventor: Kevin V. Maloney, Long Beach, Calif.

[73] Assignee: Rubbermaid Incorporated, Wooster, Ohio

[21] Appl. No.: 558,952

[22] Filed: Jul. 26, 1990

[51] Int. Cl.[5] ..... B65D 25/28; A45C 5/00

[52] U.S. Cl. ..... 16/112; 16/115; 16/335; 190/18 A; 190/115; 280/47.26; 280/47.371; 280/37

[58] Field of Search ..... 16/112, 115, 116 R, 16/126, 335, DIG. 12; 280/37, 38, 47.17, 47.26, 47.371; 190/18 A, 18 R, 39, 115

[56] References Cited

U.S. PATENT DOCUMENTS

| | | | |
|---|---|---|---|
| 3,224,790 | 12/1965 | Holstein | 16/115 |
| 3,799,568 | 3/1974 | Hagar . | |
| 3,805,929 | 4/1974 | Kuwayama . | |
| 3,948,365 | 4/1976 | Gregg et al. . | |
| 3,989,128 | 11/1976 | Walker . | |
| 4,254,850 | 3/1981 | Knowles . | |
| 4,256,320 | 3/1981 | Hager | 16/115 |
| 4,299,313 | 11/1981 | Null . | |
| 4,358,005 | 11/1982 | Fontana . | |
| 4,358,006 | 11/1982 | Castelli . | |
| 4,406,353 | 9/1983 | Walker . | |
| 4,524,482 | 6/1985 | Mueller . | |
| 4,561,526 | 12/1985 | Winter et al. . | |
| 4,575,109 | 3/1986 | Cowdery . | |
| 4,813,520 | 3/1989 | Lin . | |
| 4,838,396 | 6/1989 | Krenzel | 190/18 A |
| 4,928,800 | 5/1990 | Green et al. | 190/115 |

*Primary Examiner*—Lowell A. Larson
*Assistant Examiner*—Thomas C. Schoeffler
*Attorney, Agent, or Firm*—Richard B. O'Planick

[57] ABSTRACT

A retractable handle assembly is disclosed, comprising an elongate handle body (8, 10) having a lower end pivotally attached to an upper surface of the storage case, and extendable from a retracted position to an extended position. The handle body is adapted having an elongate internal cavity, and a profiled opening (56) extending through a lower surface. A release spring plate member (16) is fixedly mounted at one end within the handle body cavity, and has a profiled free end extending within the cavity in cantilever fashion toward handle lower body end. The release spring plate member pivots about the anchored end in a direction transverse to a longitudinal axis of the handle body. A handle link plate member (22) is further provided having a lower end pivotally attached to the case upper surface, inboard of the handle lower end. A free upper end (70) of the handle link plate member extends through the handle body opening to reciprocally move along the release spring plate member as the handle body is pivoted between the retracted and extended positions. A pivotal handle gripping portion (24, 26) remotely attached to the handle body is further provided to swing from a retracted position to a perpendicular, extended position and incorporates an integral lock.

19 Claims, 5 Drawing Sheets

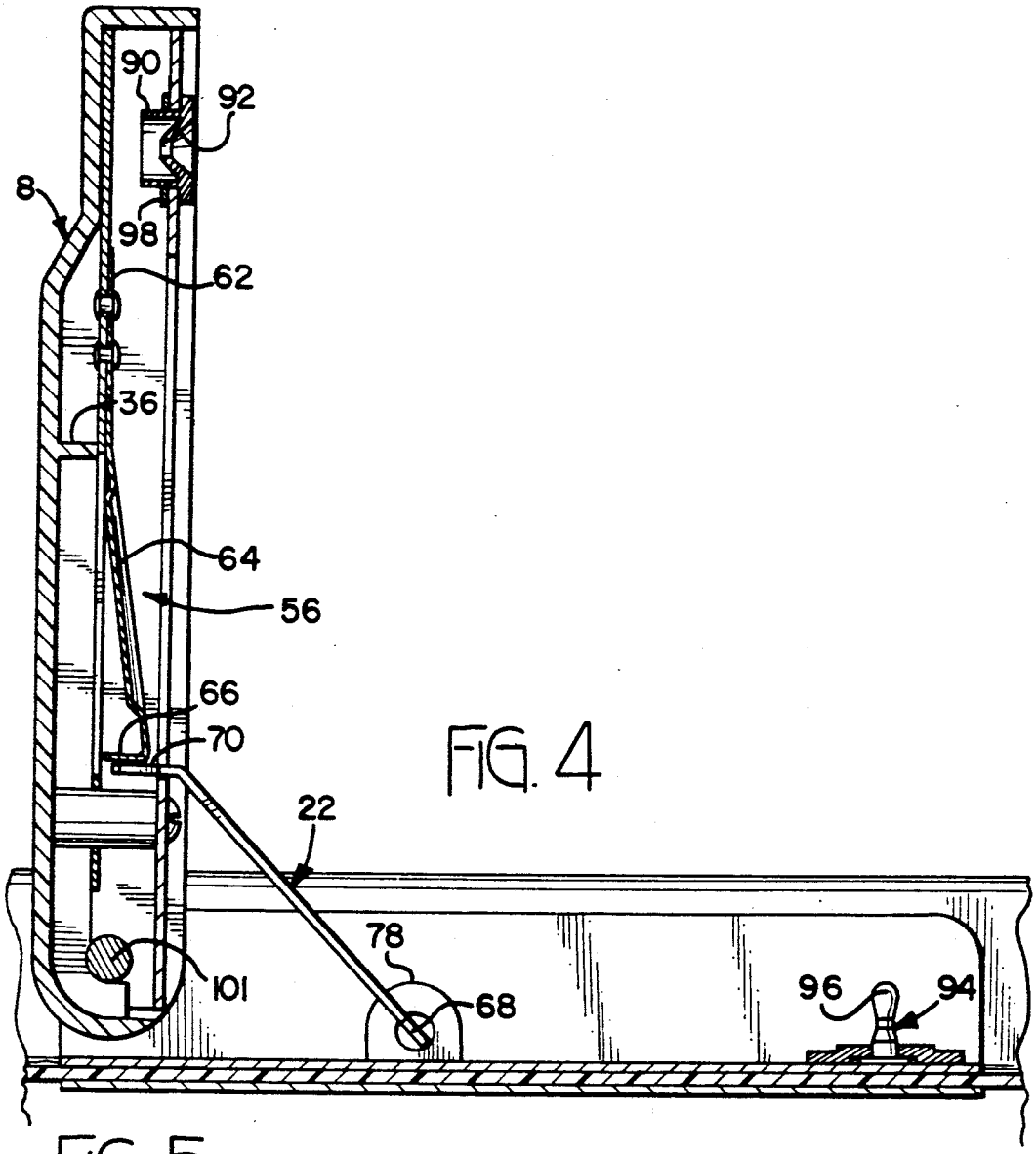
FIG. 4
FIG. 5
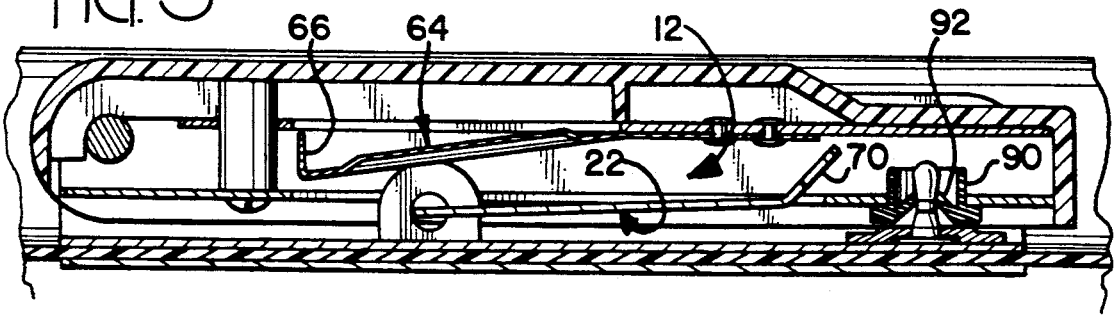

RETRACTABLE HANDLE ASSEMBLY FOR A TRANSPORTABLE CASE

BACKGROUND OF THE INVENTION

1. Field of the Invention

The subject invention relates generally to a handle assembly for a transportable case, and specifically to a retractable handle assembly which extends three-dimensionally to pull a wheeled storage case for computers or the like.

2. The Prior Art

Retractable handle assemblies for transportable cases are generally well-known, and are used for applications such as luggage or computer carrying cases. Typically such assemblies consist of a handle which is mounted pivotally to an upper surface of the case, and which extends from a storage position to an extended position for use. The remote end of the handle assembly is adapted to provide a gripping area for a user to manually grasp the handle, and thereby pull the wheeled case along.

While conventionally available retractable assemblies are commercially well accepted, several shortcomings prevent current available handle assemblies from satisfying all the needs of the end user. First, conventional assemblies are complicated, having multiple parts and requiring laborious assembly. This adds to the cost of the overall case unit, and limits its commercial appeal. Secondly, handle assemblies which are currently in use with wheeled cases are not extendable in three-dimensional planes, nor do they provide a positive automatic lock in the extended use position. In addition, conventional handle assemblies do not incorporate an easy digitally operated lock override mechanism, by which to bring the handle assembly from its extended use position back into its storage location.

SUMMARY OF THE PRESENT INVENTION

The aforementioned shortcomings of currently available handled cases are overcome by the present invention. The subject invention teaches a retractable handle assembly for a transportable case, comprising an elongate handle body having a lower end pivotally attached to an upper surface of a storage case, and pivotally extendable from a retracted position to an extended use position. The handle body is adapted having an internal elongate cavity, and a profiled opening extending through a lower surface in communication with the cavity. An elongate release spring plate member is fixedly mounted at one end within the handle body cavity, and has a profiled free end extending within the cavity in cantilever fashion toward the handle lower body end. The release spring plate member flexibly pivots about the anchored end in a direction transverse to a longitudinal axis of the handle body. A handle link plate member is further provided having a lower end pivotally attached to the case upper surface, in-board of the handle lower end, and a free upper end which extends through the handle body opening to reciprocally move along the release spring plate member as the handle body is pivoted between retracted and extended positions. Accordingly, the free ends of the release spring plate member and the handle link plate overlap and abut to retain the handle body in the extended position. A further feature of the present invention is a pivotal handle gripping portion remotely attached to the handle body, swinging from a retracted position to a perpendicular, extended position. The gripping handle portion is provided with positive locking means, whereby it is retained in the extended position until the locking mechanism is digitally overridden by the user.

Accordingly, it is an objective of the present invention to provide a handle assembly having a positive automatic locking capability.

A further objective of the present invention is to provide a retractable and extendable handle assembly having sequentially extendable linkages.

A further objective of the present invention is to provide a retractable and extendable handle assembly having three-dimensionally extendable handle linkages.

Yet a further objective of the present invention is to provide a handle assembly having digitally operable, single handed extension and retraction linkages.

Still a further objective of the present invention is to provide a retractable and extendable handle assembly having relatively few component parts, which are readily assembled and economically manufactured.

These and other objectives, which will become apparent to one skilled in the art, are achieved in a preferred embodiment which is described in detail below, and which is illustrated in the accompanying drawings.

BRIEF DESCRIPTION OF THE DRAWINGS

FIG. 4 is a transverse sectional view through the subject handle assembly, shown in the extended position, and including structure which mounts to the wheeled storage case.

FIG. 5 is a transverse sectional view through the subject handle assembly, shown in the retracted position, and seated against the wheeled storage case.

DESCRIPTION OF THE PREFERRED EMBODIMENT

Figure 1:
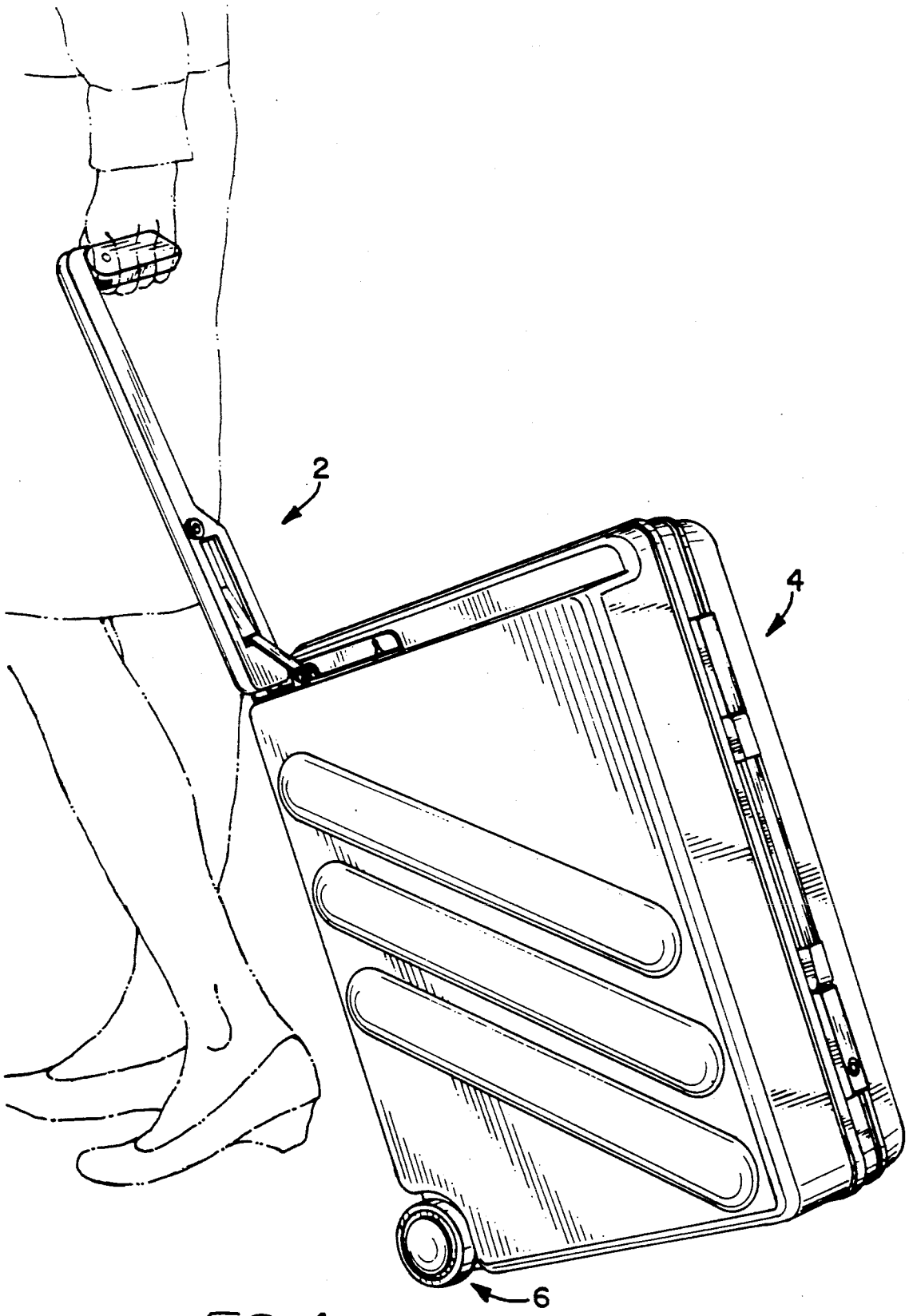
FIG. 1 is an assembled perspective view of the subject retractable handle assembly, shown in the extended position, appropriately mounted to a wheeled case.

Referring first to FIG. 1, the subject handle assembly 2 is shown appropriately mounted to the top surface of a transportable case 4. Transportable case 4 is shown to be mounted on wheels 6, rotatably secured to a lower left corners of case 4. It will be appreciated that the handle assembly 2 is used to wheel the transportable case along the ground surface. Luggage, or computer carrying cases, for example, typically use retractable handles for assisting the user in transporting the heavily loaded contents of such cases along the ground surface.

Figure 2:
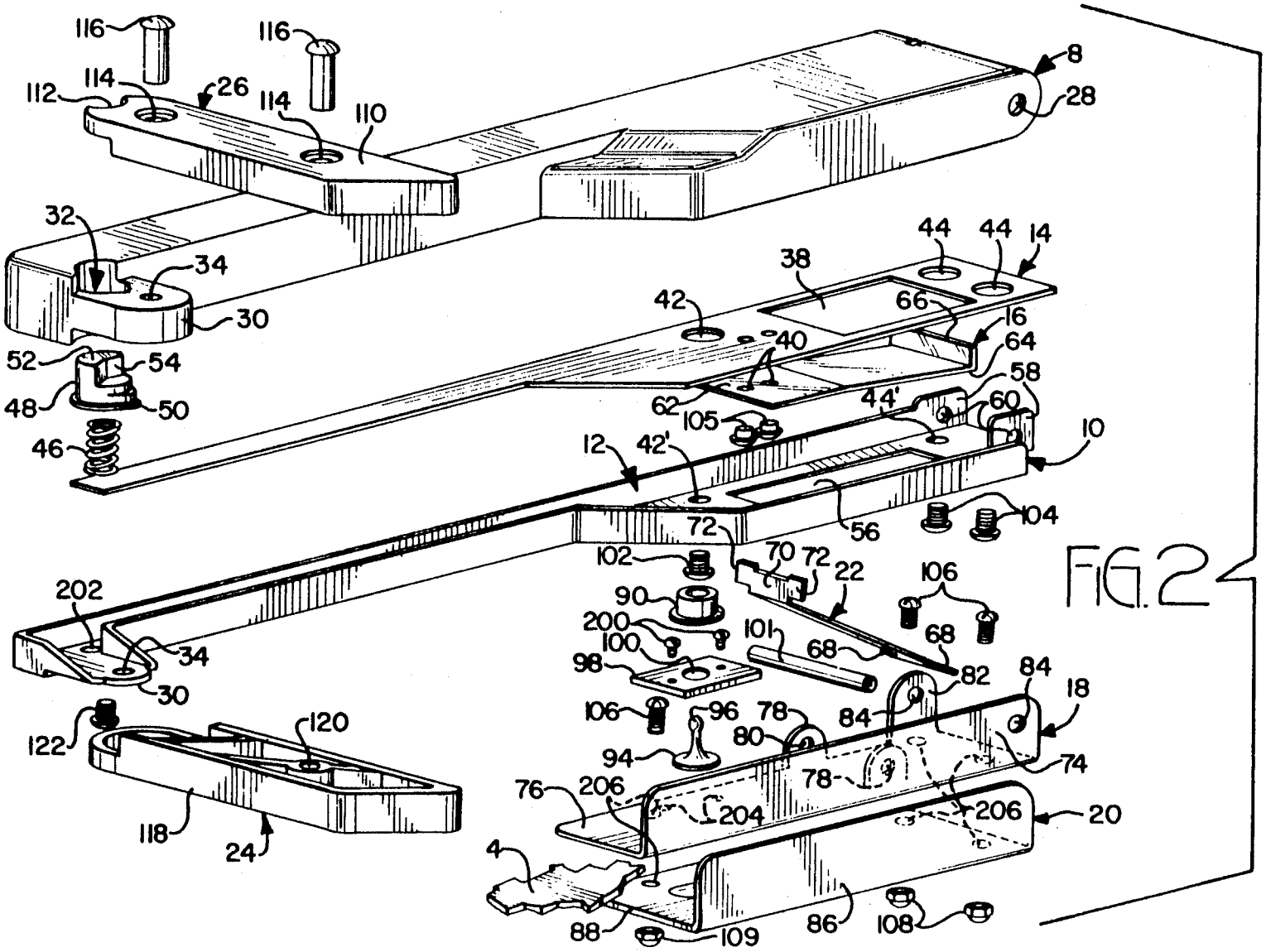
FIG. 2 is an exploded perspective view of the subject retractable handle assembly.
Figure 3:
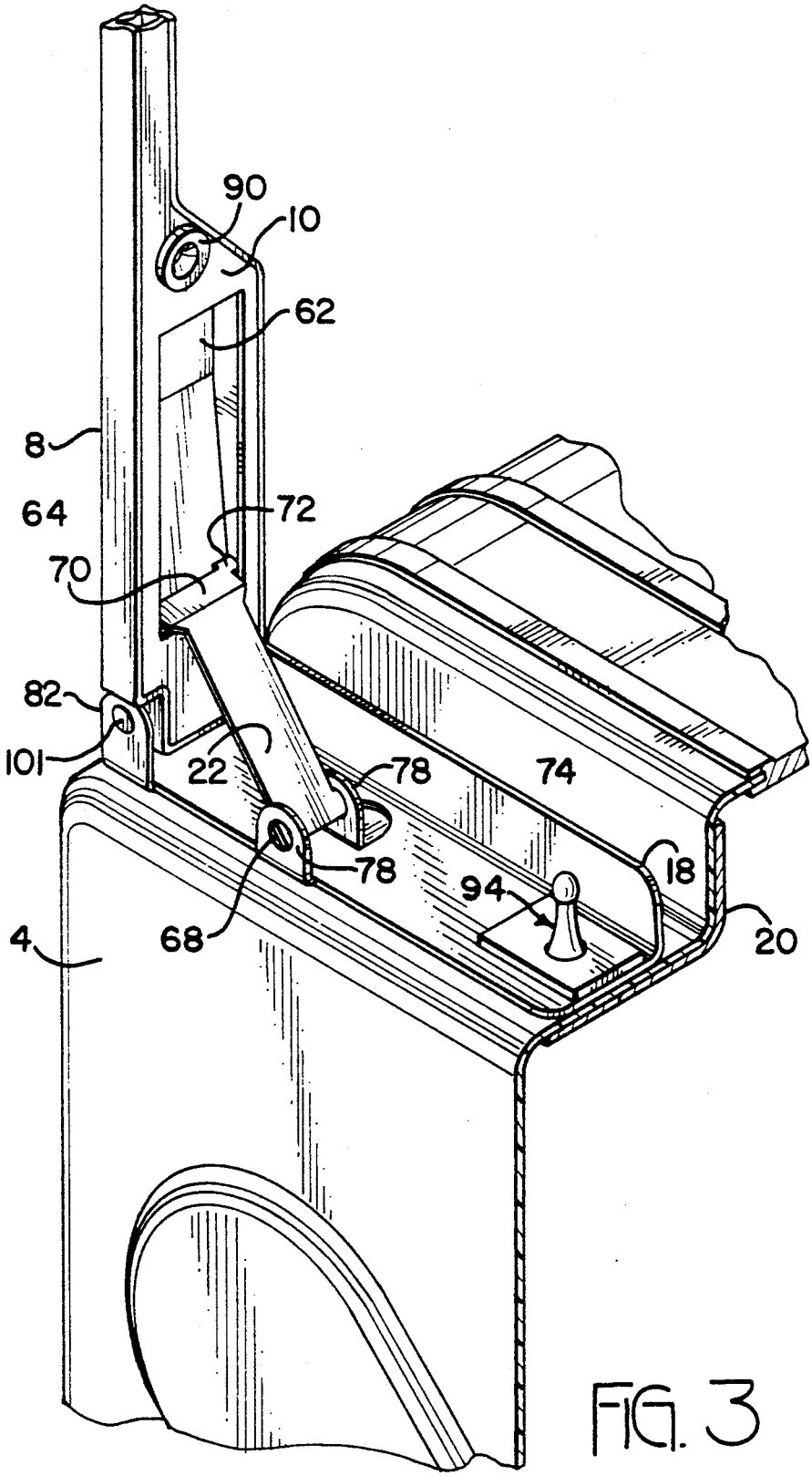
FIG. 3 is a perspective view showing the subject retractable handle assembly in its extended position, detailing features of the operating mechanism and the attachment of the handle assembly to the storage case depicted in FIG. 1.

Referring to FIGS. 1, 2, and 3, the handle assembly is shown to comprise an elongate profiled upper handle body plate 8, a lower handle body plate 10, which, when secured together, define an internal elongate cavity 12. Interposed between the upper handle body plate 8 and lower body plate 10 is a handle insert plate 14, which is welded to plate 10, and which resides within and extends along internal cavity 12. Component 8 is conventionally molded of plastic material.

A metallic release spring member 16 is shown, attachable to the handle insert plate 14. An L-shaped metallic upper mounting bracket 18 attaches to a lower metallic mounting bracket 20, which is affixed by conventional means to an upper surface of the carrying case 4, as shown in FIG. 1. A metallic handle link plate 22 is shown for pivotal attachment to the upper mounting bracket 18.

Further comprising the subject handle assembly is a hand grip portion, consisting of a lower hand grip plate 24, and an upper hand grip plate 26. A pivot aperture 28 extends through the lower end of the body plate 8. The lower hand grip plate 24 and upper hand grip plate 26 are attachable to a mounting bosses 30 in the handle body upper plate 8 and lower body plate 10, respectively, each boss having an assembly pivot aperture 34 therethrough. A profiled actuation button hole 32 extends through the mounting boss 30 of plate 8, as shown in FIG. 2.

FIG. 4 illustrates a spacer flange 36 extending inwardly from the upper body plate 8, adapted to retain and position the handle insert plate 10. Extending through the insert plate 10 is a square shaped central opening 38. Assembly apertures 40 and 42 are disposed forwardly of the central opening 38. Further assembly apertures 44 are rearwardly disposed of central opening 38 as shown in FIG. 2.

A helical spring member 46 is positioned at the remote end of the insert plate 10. A button member 48 likewise is positioned at that remote end above spring 46, and comprising a cylindrical button base portion 50, having a top surface 52. An upper body portion 54 of button member 48 is adapted to have a generally semicircular transverse sectional profile, with a notch formed therein. FIG. 2 illustrates the shape of the button body 54.

A central square opening 56 extends through the lower handle body plate 10. Upwardly directed square attachment lugs 58 are positioned at lower corners of the plate 10, each of which having an assembly aperture 60 extending therethrough. The release spring plate 16 is adapted having a planar horizontal anchor portion 62, and a leaf spring plate portion 64. Disposed at the remote end of leaf spring plate portion 64 is an upturned end flange 66.

The handle link plate 22 is adapted to have an outwardly extending T-shaped lower end portion 68, as will be appreciated from FIGS. 2 and 3. An upturned forward end flange 70 is provided in handle link plate 22, having outwardly extending corner retention lugs 72.

The upper mounting bracket 18 is L-shaped, defined by a vertical wall 74 and a flat plate portion 76. Forward pivot flanges 78 extend upwardly from the flat plate portion 76, each having an assembly aperture 80 extending therethrough. Rearwardly disposed pivot flange 82 extends upwardly from the flat plate portion 76, having an assembly aperture 84 extending therethrough. The lower mounting bracket 20 is likewise of L-shape, defined by a vertical plate portion 86 and a flat plate portion 88, having assembly apertures 206 therethrough at forward and reward locations.

As will be appreciated from FIG. 5, an elastomeric latching socket 90 of cylindrical shape is provided, having inwardly canted retention tines 92 extending from an outward edge of the cylindrical socket 90 toward a central axial opening of socket 90. A projecting strike member 94 is also provided having an enlarged locking end 96. A square shaped assembly plate 98 is a further component, having a centrally disposed mounting aperture 100. Hardware to assemble the subject handle assembly consists of a series of screws and nuts 102, 104, 105, 106, 108, and 109 as shown in FIG. 2. The assembly will be described in detail below.

With continued reference to FIGS. 1, 2, and 3, the upper hand grip plate 26 comprises an planar gripping portion 110, having a U-shaped cut out detent 112 formed at an inward end thereof, and assembly apertures 114 extending therethrough. Assembly studs 116 are provided to extend downward through assembly apertures 114. As shown in FIG. 2, the lower hand grip plate 24 likewise comprises a planar gripping portion 118, having assembly apertures 120 extending therethrough. Screws 122, 102, 104 collectively mount plate 10 to plate 8.

Assembly of the subject handle assembly will be appreciated from the following. The mounting brackets 18, 20 are attached to the upper surface of the carrying case 4. The handle link plate 22 is pivotally mounted to the upper pivot flanges 78 of upper mounting bracket 18, as outwardly projecting pivot flanges 68 extend through the assembly apertures 80 of forward pivot flanges 78.

The strike member 94 is fixedly attached to the bracket plate 18 by means of assembly plate 98, with rivets 200, through apertures 204. The locking end 96 of strike member 94 protrudes upwardly through aperture 100, generally perpendicular to the horizontal plate portion 76. The latch socket 90 is securely affixed to the lower handle body plate 10, in a position so as to coalign with and receive the strike member locking end 96 when lower handle plate 10 is in its retracted position against the upper surface of the carrying case. FIG. 5 illustrates the retracted position of the handle assembly.

The upper handle body plate 8, lower handle body plate 10, and handle insert plate 14 are assembled as illustrated in FIGS. 2, 4, and 5, by means of assembly screws 104 which are inserted through apertures 44, and 44', screw 102 through aperature 42, and screw 122 through aperture 202. The release spring 16 is affixedly attached to the insert plate 14, as the anchor plate portion 62 is secured to the insert plate by means of studs 105 extending through apertures 40. So positioned, the leaf spring plate portion 64 extends downwardly toward the central square opening 56 in the lower handle body plate 10. Leaf spring plate portion 64 is thereby resiliently anchored within the central cavity 12, digitally accessible through the lower central square opening 56. Leaf spring portion 64, it will be appreciated, is transversely flexible relative to the longitudinal axis of body plates 8, 10, moving within opening 38.

The complete assembled handle is pivotally attached by means of apertures 28 on body 8, 60 on body 10, and pivot pin 101 to the pivot flanges 82 of bracket member 18. So located, the handle body pivots upwardly from the retracted position illustrated in FIG. 4 to an extended position, whereby the handle body is perpendicular to the upper surface of the carrying case. The handle further can pivot downward to a retracted storage position against the upper surface of the carrying case, shown in FIG. 5.

From FIG. 5 it will be noted that the upper end flange 70 of the handle linkage plate 22 is positioned within the central cavity 12, and that, upon extension of the handle assembly to the vertical orientation of FIG. 4, flange 70 moves along the leaf spring plate portion 64 of release spring 16, until end flange 70 overrides end flange 66. FIG. 4 illustrates the fully extended position of the handle, with flange portion 66 and 70 in abutment. Thereafter, to retract the handle assembly, digital pressure is applied to leaf spring portion 64, whereby deflecting the spring portion inwardly, to release upturned end flange 70. Thereafter, the handle assembly can be freely pivoted downward into the storage position of FIG. 5.

It should be noted that the link plate flanges 72 are slideably captured between the release spring plate portion 64 and the lower handle body plate 10, for retaining the link plate end 70 within the handle body cavity 12.

It will be appreciated from FIG. 5 that the strike member portion 96 is resiliently retained within the latch collar 90 by retention tines 92. The positive lock between the strike member 94 and the latch member 90 is overridden manually by an upper pressure applied to the handle assembly. The handle assembly is thusly freed from its storage position against the upper surface of the storage case by application of single handed pressure, and brought into the vertical upright position illustrated in FIG. 4. Also, by single handed release of leaf spring portion 64, the handle is unlocked and freed to pivot downwardly into the storage position of FIG. 5. It will be appreciated that the positive lock achieved between the spring member 16 and the handle linkage plate 22 operates automatically after the handle assembly reaches its fully extended position.

The hand grip portion at the remote end of the handle assembly can be pivoted outwardly after the handle assembly is in its vertical use position, as illustrated in FIG. 4. It will be appreciated from FIG. 2 that the helical spring 46 is positioned between the body plate 10 and the button base 48, such that the upper surface 52 of button 50 is in alignment with the button hole 32. Assembly of hand grip portions 26 and 24 are by means of assembly studs 116 protruding through apertures 114 and 120.

Figure 7:
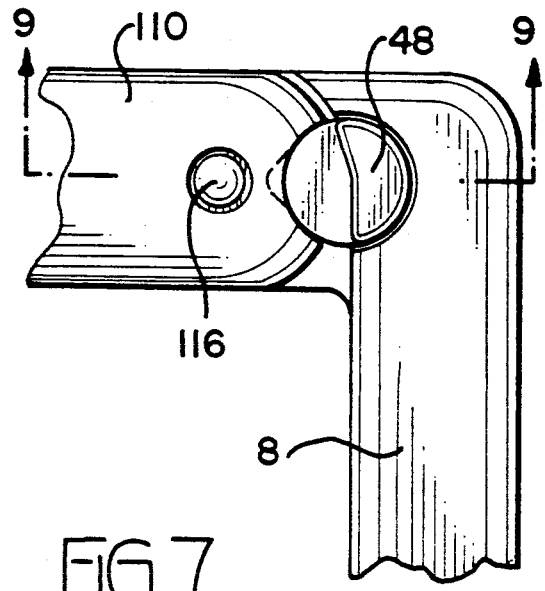
FIG. 7 is a top plan view of the handle gripping portion, shown in the extended position.
Figure 6:
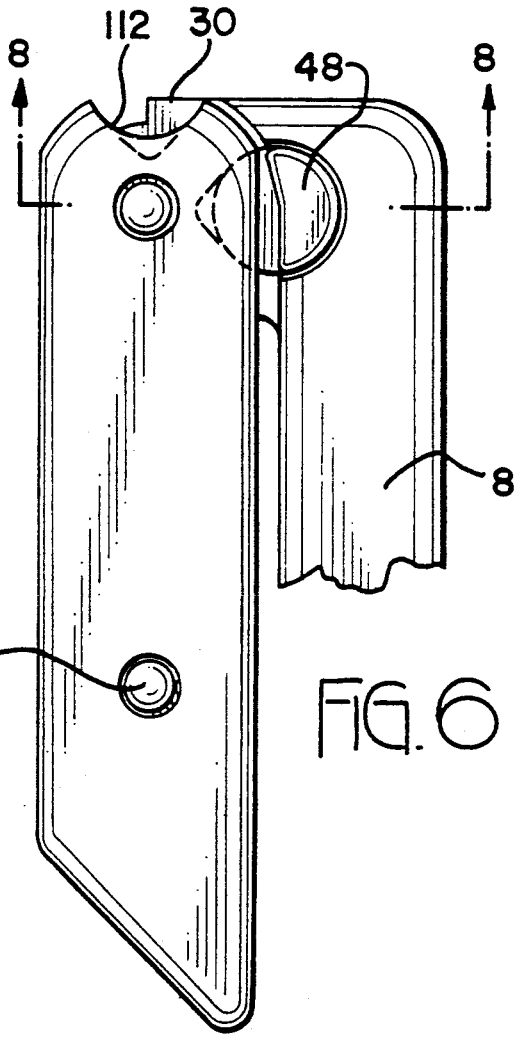
FIG. 6 is a top plan view of the handle gripping portion, shown in the retracted position.
Figure 9:
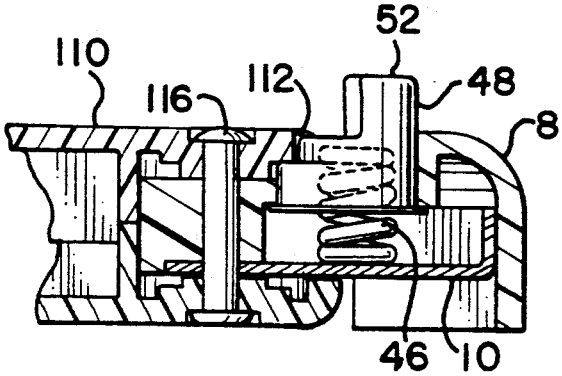
FIG. 9 is a transverse sectional view through the pivot linkage of the handle gripping portion, taken along the line 9—9 of FIG. 7.
Figure 8:
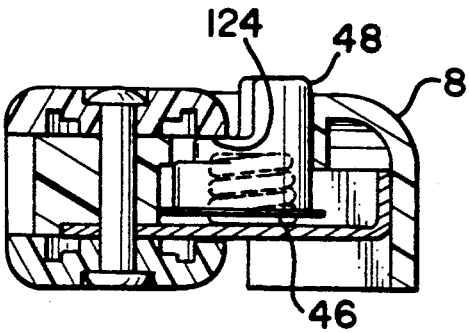
FIG. 8 is a transverse sectional view through the pivot attachment of the handle gripping portion, taken along the line 8—8 of FIG. 6.

It will be appreciated from FIGS. 6–8 that the hand grip portion (24, 26) is pivotal from the retracted position of FIG. 6 to the perpendicularly extended position of FIG. 7. In the retracted position of FIG. 6 and FIG. 8, the button 48 is depressed downwardly by surface 124. As the gripping portion is pivoted into its perpendicular orientation of FIGS. 7 and 9, the button member 48 co-aligns with the profiled cut-out detent 112, and is spring biased upwardly through the button hole 32. Protrusion of the button 48 through button hole 32 locks the handle gripping portion in its perpendicular orientation until digital pressure is applied to button 48, whereupon permitting pivoting motion of the hand grip portion inward into its retracted position of FIG. 6 and FIG. 8.

From the foregoing, it will be appreciated that the subject handle assembly consists of relatively few parts, which are easily and readily assembled by conventional means. The single hand extension of the handle body assembly relative to the top of the case has been described above. In addition, the extension of the hand grip portion is by single handed depression of button member 48. Thus, the handle assembly conveniently swings upward into an extended position by single hand operation, in two spatial dimensions, and the hand grip portion swings outwardly by single hand operation in a third dimension. Positioned, as shown in FIG. 2, the handle assembly provides the operator with convenient means for pulling the wheeled case along a horizontal surface.

While the above is the preferred embodiment of the present invention, the subject invention is not to be so confined. Other embodiments, which will be apparent to one skilled in the art, and which utilize the teachings herein set forth, are intended to be within the scope and spirit of the subject invention.

I claim:

1. A retractable handle assembly for a transportable case, comprising:

an elongate handle body having a lower end pivotally attached to an upper surface of said storage case, and pivotally extendable from a retracted position to an extended position;

said handle body having an internal elongate cavity and an elongate profiled opening extending through a lower surface in communication with said cavity;

an elongate release spring plate member fixedly mounted at one end within said handle body cavity, and having a profiled free end portion extending within said cavity toward said handle body lower end, said release spring plate member free end portion flexibly pivoting about said one end in a direction transverse to a longitudinal axis of said handle body;

a handle link plate member having a lower end pivotally attached to said case upper surface inward of said handle body lower end, and said link plate member having a profiled free upper end portion adapted to extend through said handle body opening and to reciprocally move along said release spring plate member as said handle body is pivoted between said retracted and said extended positions, and said free end portions of said spring plate member and said handle link plate releasably assuming a locking orientation to retain said handle body in said extended position.

2. A handle assembly according to claim 1, wherein said release spring plate member and said handle link plate member being in opposed spring tension as said handle body is pivoted between said retracted and said extended positions.

3. A handle assembly according to claim 2, said handle link plate free end portion flexing outward beyond said release spring plate free end portion, whereby locking said handle body into said extended position.

4. A handle assembly according to claim 3, said release spring plate free end portion flexing inwardly to release said handle link plate free end portion, whereby enabling a retraction of said handle body.

5. A handle assembly according to claim 4, said inward flexing of said release spring plate member being actuated by digital hand pressure, applied through said handle body opening.

6. A handle assembly according to claim 5, said handle body having locking means for releasably engaging said case upper surface, whereby retaining said handle body against said case upper surface.

7. A handle assembly according to claim 6, said handle link plate free end portion having outward retention flange means slideably captured between said release spring plate and said handle body lower surface, for retaining said link plate free end portion within said handle body cavity.

8. A handle assembly according to claim 7 or claim 1, further comprising a remote handle gripping portion rotatably affixed to a distal end of said handle body, and pivotal from a storage position against said handle body to an extended position at substantially a right angle to said handle body.

9. A handle assembly according to claim 8, said handle gripping portion comprising locking means for releasably retaining said handle gripping portion in said storage position.

10. A handle assembly according to claim 9, wherein said locking means comprising a spring biased button member housed between upper and lower surfaces of said handle body portion, and a detent formed within said handle gripping portion aligned to receive said button member as said handle gripping portion pivots into said extended position.

11. A retractable handle assembly for a transportable case, comprising:

an elongate handle body having a lower end pivotally attached to an upper surface of said case, and pivotally extendable from a retracted position to an extended position, said handle body having an internal elongate cavity and an elongate profiled opening;

an elongate release spring member fixedly mounted at one end to said handle body within said cavity, and having a profiled free end portion extending within said cavity toward said handle body lower end, said release spring member flexing in a direction transverse to a longitudinal axis of said handle body;

a handle link member having a lower end pivotally attached to said case upper surface inward of said handle body lower end, and said link member having a profiled free upper end portion adapted to extend through said handle body opening and reciprocally move along said release spring member in opposed spring tension thereagainst as said handle body is pivoted between said retracted and said extended positions.

12. An assembly according to claim 11, further comprising a remote handle gripping portion rotatably affixed to a distal end of said handle body, and pivotal from a storage position adjacent said handle body to an extended position at substantially a right angle to said handle body.

13. An assembly according to claim 12, said handle gripping portion comprising locking means for releasably retaining said handle gripping portion in said storage position.

14. An assembly according to claim 13, wherein said locking means comprising a spring biased member housed between upper and lower surfaces of said handle body portion, and a detent formed within said handle gripping portion so as to align and receive said button member as said handle gripping portion pivots into said extended position.

15. An assembly according to claim 11, said handle link plate free end portion flexing outward upon passing said release spring plate free end portion, whereby locking said handle body into said extended position.

16. An assembly according to claim 15, said release spring plate free end portion flexing inwardly to release said handle link plate free end portion, whereby enabling a retraction of said handle body.

17. An assembly according to claim 16, said inward flexing of said release spring plate member being actuated by digital hand pressure, applied through said handle body opening.

18. An assembly according to claim 17, said handle body having locking means for releasably engaging said case upper surface, whereby retaining said handle body in said retracted position.

19. An assembly according to claim 18, said handle link plate free end portion having outward retention flange means slideably captured between said release spring plate and said handle body lower surface, for retaining said link plate free end portion within said handle body cavity.

* * * * *